United States Patent [19]

Veitl

[11] 4,007,064

[45] Feb. 8, 1977

[54] PROCESS OF PRODUCING SURFACE-DECARBURIZED STEEL SHEETS OR PLATES

[75] Inventor: Giswalt Veitl, Linz, Austria

[73] Assignee: Vereinigte Österreichische Eisen- und Stahlwerke-Alpine Montan Aktiengesellschaft, Linz, Austria

[22] Filed: Sept. 24, 1975

[21] Appl. No.: 616,380

[30] Foreign Application Priority Data

Oct. 23, 1974 Austria ..... 8503/74

[52] U.S. Cl. ..... 148/12.1

[51] Int. Cl.[2] ..... C21D 1/74; C21D 3/04

[58] Field of Search ..... 148/12.1

[56] References Cited

UNITED STATES PATENTS

| | | | |
|---|---|---|---|
| 2,324,808 | 7/1943 | Abbott | 148/12.1 |
| 3,868,277 | 2/1975 | Leroy et al. | 148/12.1 |

*Primary Examiner*—W. Stallard

*Attorney, Agent, or Firm*—Brumbaugh, Graves, Donohue & Raymond

[57] ABSTRACT

A process for producing surface-decarburized steel sheets or plates involves the formation of a package or pile by alternately superimposing decarburizing high alloy chromium steel sheet layer(s) and the steel sheets(s) or plate(s) on each other. Edge welding seams are applied to the package or pile, which is then heated to rolling temperature and rolled, subsequently annealed in the carbide-forming range, and then separated.

6 Claims, 2 Drawing Figures

PROCESS OF PRODUCING SURFACE-DECARBURIZED STEEL SHEETS OR PLATES

BACKGROUND OF THE INVENTION

The invention relates to a process for producing surface-decarburized steel sheets or plates by heating a pile or package of alternate layers of a decarburizing agent and the steel sheet(s) or plate(s).

Processes for the surface-decarburization of steel sheets or plates are known. According to such a process carbon and other impurities can be removed by heating the sheets or plates in an atmosphere containing free hydrogen in the presence of aluminum silicide, calcium silicide or the like. According to another process the sheets or plates are decarburized by annealing them in a hydrogen atomosphere, wherein the hydrogen consumed in the decarburization process by the formation of methane is regenerated with the help of metallic calcium that is strewn about the sheet surface.

Surface-decarburization processes are also known, from German Auslegeschrift No. 1,193,527 and Austrian Pat. No. 223,224, in which the sheets or plates to be decarburized are alternately put together with calcium foils or with layers of comminuted calcium aluminum alloy to form a pile. The pile is then heated to a temperature of between 700° and 1200° C in the absence of hydrogen. In the decarburizing-agent layers, alkali earth oxides, such as MgO, CaO, SrO or BaO, can be included in order to counteract the possibility of sintering. Because of the great affinity of the metallic calcium or the calcium-aluminum alloy, respectively, for oxygen, this process for decarburizing or scaling must be carried out in an inert protective atmosphere of noble gases, such as helium or argon. This is complicated and expensive. A further disadvantage of using alkali earth metals or their alloys as decarburizing agents is that during heating firmly adhering coatings form, which lead to an uneven decarburization and which subsequently are very difficult to remove. When the layer of the decarburizing agent is not quite uniform, differing decarburization depths are obtained in the annealing treatment or the decarburization can even be absent in certain places.

SUMMARY OF THE INVENTION

The invention aims at preventing the above described disadvantages and difficulties and has as its object to provide a simple process for the surface decarburization of steel sheets or plates, in particular low-carbon plates. The process works without special measures, such as a decarburizing hydrogen atmosphere or an inert protective gas atmosphere, guarantees a uniform decarburization depth and uses relatively short annealing periods and simple operational means.

According to the invention this object is achieved in that (a) the pile or package is formed by bringing together one or more steel sheets or plates and at least one sheet layer of a high alloy chromium steel, acting as a decarburizing agent, with a composition of 0.02 to 0.15% C, 0.15 to 2% Mn, 0 to 2% Si, 5 to 30% Cr, 0 to 5% Ni, 0 to 5% of one of the elements Mo, W or V, 0 to 2% of one of the elements Nb, Ta, Ti or Zr, 0 to 1% rare earths, balance iron and the usual impurities, (b) fixing the pile or package by applying edge welding seams, (c) heating it to rolling temperature, (d) then rolling the pile or package, (e) subsequently annealing it at a temperature in the carbide-forming range, in particular in the temperature range between 580° and 900° C, and (f) separating the pile or package.

This process is particularly suited for surface-decarburizing weldable structural steels having about the following composition:

maximally 0.17% C
0.20 to 0.40% Si
1.20 to 1.60% Mn
maximally 0.020% P
maximally 0.020% S and an optional content of 0.50 to 0.70% Ni
0.30 to 0.45% Mo
0.08 to 0.15% V,
balance Fe.

Chromium steels of the above defined composition are known per se.

When the alternate layers of the chromium steel decarburizing agent and the steel plates are welded together a gap is left between them. Advantageously, bores are provided in the package in the area of the gaps between the chromium steel sheet layer(s) and the steel sheet(s), in order to allow for the access of oxygen or the furnace atmosphere, respectively. In this way the oxygen of the air or the furnace atmosphere has access to the surfaces to be decarburized to a certain extent with the desired consequence that the steel sheet or plate does not weld together with the chromium steel sheet layer; but, the carbon diffusion in the chromium steel, which acts as a decarburizing agent, continues substantially undisturbed.

The sheets or plates produced according to the invention are characterized by an excellent quality; their weldability and capability of being enameled are also substantially improved.

BRIEF DESCRIPTION OF THE DRAWINGS

The process according to the invention shall now be described in greater detail by way of an example and with reference to the accompanying drawings wherein.

DESCRIPTION OF EXEMPLARY EMBODIMENTS

Figure 1:
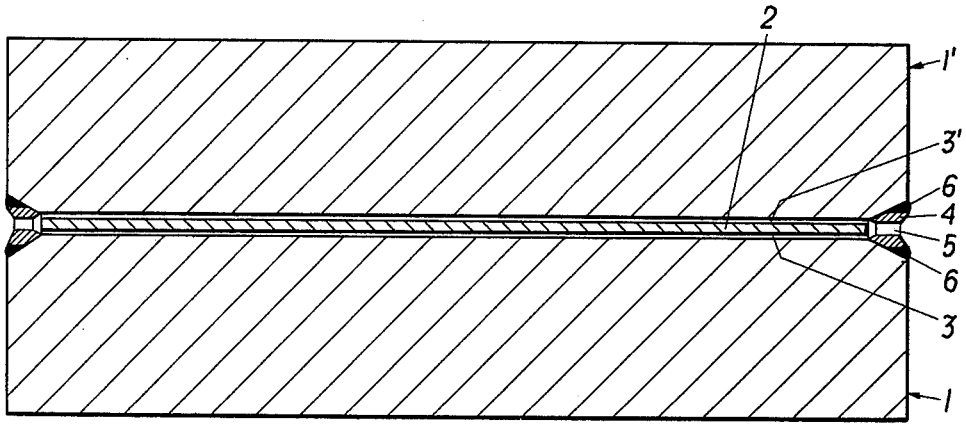
FIG. 1 is a cross-section of a package of two steel slabs with an intermediate chromium steel sheet layer.
Figure 2:
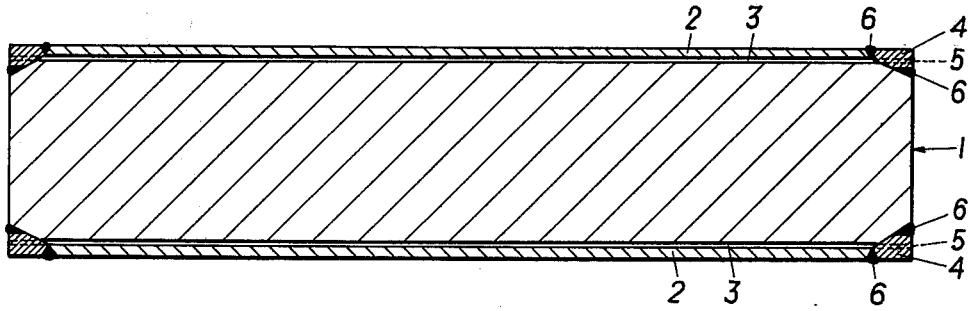
FIG. 2 is a cross-section of a package consisting of a slab with chromium steel sheet layers arranged on the opposite outer surfaces.

According to FIG. 1, the package is comprised of a slab 1 and a chromium steel sheet layer 2 that is somewhat narrower than the slab and is located on top of it so that their edges are parallel. The chromium steel has a composition corresponding to the previously mentioned range. A slab 1′ of the same width as slab 1 is located on top of the chromium steel layer 2. The pile is fixed in its position by edge bands 4, which are connected by welding seams 6 with the slab 1 and 1′, respectively so that between slab 1 and the sheet layer 2 there is a narrow gap 3 and there is a like gap 3′ present between the sheet layer 2 and the upper slab 1′. In the edge bands bores 5 are provided which allow for the admittance of air or the furnace atmosphere, respectively, into the gaps 3 and 3′. The package then is heated to rolling temperature and rolled, until the thickness of the chromium steel sheet layer is deformed to between 1/10 and 1/5 of the original thickness. In this procedure the rolling heat is used for the decarburization annealing. After the rolling the package is annealed in the carbide forming range, preferably at a temperature range of from 580° to 900° C. Then the package is opened, the remaining decarburizing agent is removed and the decarburized surfaces are cleaned. Two steel sheets or plates with one decarburized surface each are obtained. In the same way a steel sheet or plate with two decarburized surfaces can be produced, as shown in FIG. 2, in which the same parts have the same reference numerals.

Example: Two low-carbon steel slabs with the composition 0.14% C, 0.35% Si, 1.2% Mn, 0.006% P, 0.015% S, 0.68% Ni, 0.41% Mo, 0.11% V, balance Fe and the dimensions 2,150 mm length, 1,500 mm width, 300 mm height were put together, as shown in FIG. 1, with a chromium steel sheet layer having the composition 0.05% C, 0.8%Si, 1% Mn, 0.025% P, 0.02% S, 17% Cr, 0.5% Nb, 0.04% Ta and the dimensions 2,050 mm length, 1,400 mm width, 10 mm thickness, to form a package. The edges of the slabs facing the sheet layer were inclined along the periphery so that along the periphery of the pile a groove with a trapezoid cross-section was created. Into this groove the edge bands provided with bores were inserted and welded in place so as to form gaps between the chromium steel sheet and the steel slabs. The package was then kept in the usual furnace atmosphere at a temperature of 1200° C for 20 hours and was rolled to the dimensions of 7,620 mm length, 2,150 mm width, 122 mm thickness, in 26 passes. After the rolling the package was annealed for 60 hours at 750° C and separated. The remaining decarburizing agent was removed. Two plates decarburized on one side with a length of 7,300 mm, a width of 2,000 mm and a thickness of 60 mm were obtained. On the one side of the plates a very uniform decarburized depth of 2 mm was achieved.

What I claim is:

1. A process for producing surface-decarburized steel sheets or plates, comprising the steps of forming a package by bringing together at least one sheet layer of a high alloy chromium steel consisting essentially of from between 0.02 and 0.15% C, 0.15 and 2% Mn, 0 and 2% Si, 5 and 30% Cr, 0 and 5% Ni, and from between 0 and 5% of an element selected from the group consisting of Mo, W and V, from between 0 and 2% of an element selected from the group consisting of Nb, Ta, Ti or Zr, and from between 0 and 1% rare earths, balance iron and usual impurities, to serve as decarburizing agent, and at least one steel sheet or plate, fixing the package by applying edge welding seams, heating the package to rolling temperature, subsequently rolling the package, subsequently annealing the package at a temperature within the carbide forming range, and thereupon separating the package.

2. A process as set forth in claim 1, wherein the package is annealed at a temperature ranging from 580° to 900° C.

3. A process as set forth in claim 1, wherein the package is fixed so that a gap is provided between the at least one sheet layer and the at least one steel sheet or plate and wherein bores are provided adjacent said gap to allow for access of oxygen or furnace atmosphere.

4. A process as set forth in claim 1 wherein the package is formed by bringing together alternate layers of the chromium steel and the steel sheets or plates.

5. A process as set forth in claim 1 wherein the package is formed of two steel sheets or plates placed on either side of one layer of chromium steel.

6. A process as set forth in claim 1 wherein the package is formed of two layers of chromium steel placed on either side of one steel sheet or plate.

* * * * *